United States Patent [19]

Motani et al.

[11] 4,090,931

[45] May 23, 1978

[54] ANODE-STRUCTURE FOR ELECTROLYSIS

[75] Inventors: Kensuke Motani; Toshikatsu Sata; Masakatsu Nishimura, all of Tokuyama, Japan

[73] Assignee: Tokuyama Soda Kabushiki Kaisha, Japan

[21] Appl. No.: 701,576

[22] Filed: Jul. 1, 1976

[30] Foreign Application Priority Data

Jul. 7, 1975 Japan ..... 50-82814

[51] Int. Cl.[2] ..... C25B 1/46; C25B 11/00; C25B 13/02; C25B 13/04

[52] U.S. Cl. ..... 204/98; 204/252; 204/259; 204/260; 204/283; 204/296

[58] Field of Search ..... 204/98, 283, 296, 252, 204/253, 259, 260

[56] References Cited

U.S. PATENT DOCUMENTS

| | | | |
|---|---|---|---|
| 3,124,520 | 3/1964 | Juda | 204/86 |
| 3,427,234 | 2/1969 | Guthke et al. | 204/73 |
| 3,759,813 | 9/1973 | Raetzsch et al. | 204/256 |
| 3,809,630 | 5/1974 | DeNora et al. | 204/98 |
| 3,864,226 | 2/1975 | Spitzer | 204/98 |
| 3,909,378 | 9/1975 | Walunsley | 204/98 |
| 3,944,477 | 3/1976 | Argade | 204/266 |
| 3,950,239 | 4/1976 | Figireras | 204/254 |

*Primary Examiner*—F.C. Edmundson
*Attorney, Agent, or Firm*—Sherman & Shalloway

[57] ABSTRACT

An anode-structure for liquid-phase electrolysis comprising an anode and a polymer containing a cation exchange group, said polymer being laminated in the form of a film on one surface of said anode.

8 Claims, No Drawings

ANODE-STRUCTURE FOR ELECTROLYSIS

This invention relates to an anode-structure for electrolysis. Commercial production of alkali metal hydroxide, halogen gas or oxygen and hydrogen by electrolysis of aqueous solutions of alkali metal salts, especially an aqueous solution of sodium chloride, has previously relied both on a mercury method and a diaphragm method. Because of the consequent pollution by mercury, however, the mercury-method electrolysis has recently tended to go out of operation, and it is the diaphragm method that is prevalent nowadays. Water-permeable neutral diaphragms made of asbestos are generally used in the diaphragm-method electrolysis, and various suggestions in the diaphragm-method electrolysis have been made in recent years in which porous neutral diaphragms composed of fluorine-containing polymers, or porous diaphragms having cation-exchangeability is used. Neutral diaphragm means a water-permeable diaphragm having no ion exchange group, and all references to neutral diaphragms in the following description are directed to such diaphragms.

The present invention relates to a novel anode-structure in a liquid-phase electrolysis apparatus using ion-exchange membranes that are characterized by affording high purity products.

It is an object of this invention to support a diaphragm stably, make it possible to operate an electrolytic cell at low voltages, and prolong the lifetime of the diaphragm and an anode. The invention also permits an increased output per unit electrolytic cell, an increased purity of chlorine gas evolved at the anode, an increased current efficiency, and a reduction in power consumption.

The present invention provides an anode-structure for liquid-phase electrolysis comprising an anode and a polymer containing a cation exchange group, said polymer being laminated in the form of a film on one surface of said anode.

The "lamination of the polymer containing a cation exchange group" means that the polymer is laminated in the form of a film to one surface of the anode using various techniques such as adhesion, melt-adhesion, polymerization or condensation either directly, or indirectly through a suitable medium.

Generally, in conventional electrolytic devices using cation exchange membranes, the anode or cathode is completely separated from the cation exchange membranes. The cation exchange membranes are merely disposed at suitable positions between the anode and the cathode, or are merely placed in juxtaposition with the anode or cathode in a parallel relation. Since the cation exchange membranes have shorter lives than the anode and cathode, the concept of laminating them into a unitary structure has not been disclosed.

As a result of lamination, the diaphragm is supported stably. When the anode and the diaphragm are merely placed in juxtaposition, a gas stays in the inerstices of the network structure or lattice structure that makes up the anode (the formation of a "gas pocket"), and electric resistance attributable to bubbles of the staying gas and electric resistance by the rising of a part of the gas between the anode and the diaphragm cause an increase in voltage. According to the present invention, however, the diaphragm naturally enters the interstices of the network structure or lattice structure that makes up the anode, and consequently, no gas pocket occurs. In other words, there is no staying of gas bubbles, but the gas generated easily rises along the back surface of the anode. As a result, the cell voltage can be decreased by about 150 to 200 mV as compared with the case of mere juxtaposition of the anode and the diaphragm. The reduction of the cell voltage directly affects the operating cost, and is exceedingly significant in reducing the cost of production.

The present invention also offers an advantage of prolonging the life of the diaphragm and the anode. As a result of lamination, the diaphragm and the anode are free from damages which normally occur by friction between them when they are merely juxtaposed to each other. Furthermore, the anode-structure of the invention is free from the phenomenon in which colloidal materials present in the gas pocket adhere to the diaphragm to reduce its function. When the anode and the diaphragm are merely juxtaposed with each other, slight vibration occurs in the diaphragm during operation, but as a result of lamination, such vibration is prevented. Accordingly, this brings about unexpected superior results in increasing the life of the diaphragm. Usually, the lamination increases the life of the diaphragm by about 20 to 30%. The increase in the life of diaphragms which are expensive is not only economically advantageous, but also significant in that electrolysis can be carried out continuously over prolonged periods of time and the frequency of diaphragm exchanging operations can be reduced.

Since cation exchange membranes generally lack flexibility, a cation exchange membrane in a planar form is difficult to utilize as a diaphragm for a wavy-form electrode such as in a finger-type electrolytic cell. However, by laminating a film of a polymer on a wavy-form electrode, the electrode structure formed can be utilized also for a wavy-form electrode used in a finger-type electrolytic cell which affords a large output per unit electrolytic cell, and for other electrodes of optional shapes.

Anodes now in widest use are those obtained by coating the surface of a corrosion-resistant metal such as titanium with a noble metal such as ruthenium, iridium, rhodium, or palladium, or an oxide of the noble metal. According to the present invention, it is desirable to use an anode which does not have such a coating on that surface to which an ion-exchangeable polymer is to be laminated.

Generally, a cation migrates into a cathode compartment through the diaphragm and water is decomposed on the cathode to generate an alkali metal hydroxide and hydrogen gas. Advantageous results in regard to current efficiency can be obtained by laminating a film of a polymer having a cation exchange group on that side of the anode. This is because the concentrated alkali metal hydroxide near the cathode does not make direct contact with the surface of the membrane.

In general, an aqueous solution of an alkali metal hydroxide has a higher electric conductivity than an aqueous solution of an alkali metal salt under conditions for commercial electrolysis. Accordingly, the use of the anode-structure of this invention gives superior results in regard to electric power consumption.

In commercial-scale electrolytic cells, electrolysis should generally be carried out while maintaining the cathode compartment at elevated pressures so as to prevent the introduction of oxygen from the atmospheric air which will cause explosion of the hydrogen gas generated at the cathode. Elevated pressures act to further stabilize the supporting of the diaphragm to the anode in the anode-structure of the present invention.

The anode-structure of this invention is now described in greater detail.

The polymer having a cation exchange group used in this invention may be any of known polymers containing a cation exchange group. Preferred polymers are generally those which contain known cation exchange groups and are feasibly oxidation- and reduction-resistant to gases generated in the anode and cathode compartments. Specific examples of the oxidation-resistant polymers containing a cation exchange group are a sulfonated polymer of $\alpha,\beta,\beta$-trifluorostyrene, and a hydrolyzate of a membrane of a copolymer of tetrafluorostyrene and perfluoro(3,6-dioxa-4-methyl-7-octenesulfonyl fluoride)

$$CF_2{=}CFOCF_2CF(\overset{\overset{SO_2F}{|}}{CF_3})OCF_2CF_2 .$$

The cation exchange groups may be possessed by the polymer itself, or introduced into the polymer before or after the lamination.

Corrosion-resistant anodes known heretofore to be usable in the electrolysis of an aqueous solution of an alkali metal salt can be used in the present invention. For example, there can be used a carbon electrode; a metal electrode obtained, for example, by coating ruthenium oxide and titanium oxide or platinum-iridium on titanium; and a magnetite electrode, etc. An insoluble anode resulting from the coating of titanium with ruthenium oxide, etc. is most preferred. The shape of the anode is not at all limited, but any desired shapes, such as a network, lattice, porous sheet, rod, cylinder, wickerwork, or finger type, can be used.

The present invention is most effective commercially when the anode has a curved surface, e.g., a loop anode, or finger-type anode. Generally, the anode material is coated on both of its surfaces, but in the present invention it is most preferred to render only one surface of the anode electrochemically inactive and laminate an ion-exchange membrane to the inactive surface. This is because when an anode coated on both surfaces is used, an electrode reaction occurs at the laminated surface during electrolysis at a high current density, and the ion-exchange membrane is stripped off from the anode.

The greatest feature of the present invention is that the polymer having a cation exchange group is laminated in the form of a film on one surface of the anode. In laminating the polymer onto the anode, any methods which ensure the firm adhesion of the polymeric film to the surface of the anode can be used. The "lamination", as used in the present invention, denotes a condition in which the polymer is firmly bonded to the anode. More preferably, it affords such a laminate strength that when the laminated ion exchange membrane is stripped off from the anode by an external force, the polymer is no longer usable for electrolysis because of reduced strength, formation of pinholes, or breakage, etc. Specific means of lamination will be described hereinbelow, but generally, a technique of laminating the polymer onto one surface of the anode by melt adhesion, and a technique of forming a film directly on one surface of the anode are most preferred in the present invention because adhesives which can withstand electrolyzing conditions and can afford the required laminate strength are few. Examples include a method which comprises polymerizing or condensing monomers containing a polymerizable or condensable functional group or a monomeric composition consisting of the monomer, a plasticizer, a backing material, a soluble polymer, etc. on the surface of an anode to form a polymeric film on the anode surface; a method which comprises adhering a powdery polymer to the surface of an anode by, for example, electrostatic attraction, and melting it into a film and fixing it to the surface of the anode; a method which comprises mixing a powdery polymer having an ion exchange group or an inorganic ion exchanger with a tacky binder, coating the mixture on the surface of an anode, and cementing the mixture to the anode surface utilizing a solidifying action of the binder; a method which comprises dissolving a polymer in a solvent, coating the solution on the surface of an anode, and removing the solvent to form a film and adhere it to the anode; a method which comprises melting a polymer, coating it in the form of a film onto the surface of an anode, and solidifying it by cooling thereby to adhere it to the anode surface; and a method which comprises coating a polymeric composition composed mainly of a liquid or plastic polymer on the surface of an anode, and subjecting the coating to a crosslinking treatment to harden it and adhere it to the anode surface. Preferred embodiments can be achieved by a method which comprises forming an organic or inorganic substance into a film form on the surface of an anode and at the same time fixing it to the anode.

Some specific examples of the laminating technique are given below.

1. In order to laminate a heterogeneous cation exchange membrane onto the surface of an anode, a fine powder of a polymerized or condensed cation exchange resin or an inorganic ion exchanger is uniformly mixed with a suitable thermoplastic polymer, and the mixture is adhered to a metal as an anode (sometimes referred to simply as an electrode). Alternatively, the fine powder of ion exchange resin is uniformly dispersed in a viscous solution of a linear polymer, and the dispersion is adhered uniformly to the electrode by coating, dipping, or spraying, etc., followed by evaporating off the solvent. In still another embodiment, the inorganic ion exchanger is mixed with cement, and the mixture is adhered to the electrode. In this way, the polymer can be laminated on the anode by utilizing conventional techniques used for the production of heterogeneous ion exchange membranes.

2. Likewise, uniform cation exchange membranes can be laminated to the anode by applying various conventional techniques heretofore suggested for the production of uniform ion-exchange membranes.

Some specific embodiments are given below.

(a) One embodiment comprises adhering a monomer containing a polymerizable functional group such as vinyl or allyl to the electrode either directly or through a backing placed on the electrode by such means as coating, dipping or spraying, and heating the assembly to polymerize the monomer. Where it is necessary to prevent sagging of a solution of a polymer, the viscosity of the material is adjusted according to the shape of the anode, or it is covered with a suitable film such as Cellophane.

The liquid viscous coating solution used in this embodiment contains at least one fluorine-containing vinyl monomer or allyl monomer, and in order to increase the viscosity of the solution, a soluble oxidation-resistant polymer, and a finely divided dispersible oxidation-resistant polymer may be incorporated.

The resulting viscous composition is adhered to the electrode by suitable means such as coating, dipping or spraying, and heat-polymerized at elevated pressures or at atmospheric pressure to obtain the structure of this invention. If desired, it may be subjected to sulfonation, hydrolysis or other known means to introduce cation exchange groups or conversion to cation exchange groups.

The polymerization may be performed either radically or ionically if only it results in insoluble polymeric structures, and ionizing radiation, X-ray or optical energy, etc. can also be used.

(b) A method using a linear polymeric electrolyte can also be cited. This method involves dissolving a fluorine-containing cationic polymeric electrolyte in a suitable solvent, adhering the solution to the electrode by suitable means such as coating, dipping or spraying, and dissipating the solvent. The resulting film, if insoluble under service conditions, can be directly used. If not, it is insolubilized by a suitable means such as ionizing radiation, X-ray radiation or optical energy ray radiation.

The fluorine-containing polymeric electrolyte can be applied from solution in the copresence of an oxidation-resistant soluble polymer or dispersible polymer. In this case, the film becomes insoluble by the van der Waals force between the polymers, or the interwining of the polymer chains to one another, and thus adheres to the electrode.

Another effective method comprises heating a linear polyelectrolyte or a thermoplastic polyelectrolyte convertible to a linear polyelectrolyte by a simple means such as hydrolysis and insoluble in water, salts, or acidic or basic aqueous solutions used, and thus melt-adhering it to the electrode, and if required, introducing an ion exchange group. Especially preferred linear polymers of this kind are expressed by the following formula

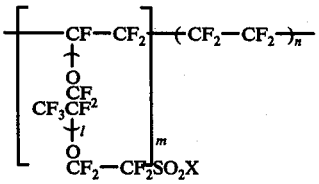

wherein $m$ is a positive integer, $l$ and $n$ are 0 or a positive integer, and X is halogen or —OH.

(c) A method using a polymeric compound containing no ion exchange group is also available. This method comprises adhering a thermoplastic polymer such as polyvinyl fluoride, polyvinylidene fluoride, poly(trifluorochloroethylene) or polytetrafluoroethylene to a mesh electrode by heat fabrication to form a thin film-like coating, and introducing an ion exchange group into it by some suitable method. There is no particular restriction on the method of adhering the polymer. Effective methods include, for example, a method which comprises dissolving or dispersing at least one of the polymeric compounds, dipping the electrode in the solution or dispersion, and then driving off the solvent; a method which comprises coating or spraying the solution or dispersion on the electrode, and then driving off the solvent; a method which comprises electrostatically charging a fine powder of the above polymeric compound, charging the electrode in an opposite polarity to adhere the fine powder electrostatically to the electrode, and then heating the fine powder to melt-adhere the polymer thereto in the form of a film; a method which comprises melting the polymer at high temperatures which do not cause its heat decomposition, and dipping a wire electrode, for example, in the molten polymer to adhere it to the electrode; and a method which comprises fabricating the polymer using a wire electrode as a core. These methods are selected according to the type and properties, such as molecular weight, of the polymers used, and the material, shape and purpose of use of the electrode.

An ion exchange group, if necessary, must be introduced into the polymeric compound adhered. Where the polymer adhered permits the introduction of ion exchange groups, it is treated directly with ion exchange group introducing reagents which do not markedly corrode the material of the electrode.

Alternatively, the polymeric compound adhered is impregnated with a polymerizable vinyl or allyl compound at room temperature or at an elevated temmperature, and in the presence of a radical polymerization initiator, it is heated at elevated pressures to polymerize it under conditions which do not dissipate the impregnated compound. In this case, a crosslinkable polyvinyl compound may be caused to be copresent to form a three-dimensional structure. The polymerization means is not limited to radical polymerization, but cationic polymerization, anionic polymerization, and redox polymerization may also be employed. Where it is noticed that too large a quantity of vinyl or allyl compound is impregnated in the polymer to cause a considerable dimensional change or render its mechanical strength weaker, a suitable solvent is added to the impregnating bath to dilute it and thus reduce the amount of the compound to be impregnated. Where the amount of the vinyl or allyl compound to be impregnated is small, the polymer film adhered may be first swollen with a solvent, and then dipped in the above monomer. The amount of impregnation can of course be increased by heating.

Instead of the impregnating method described above, a vinyl or allyl monomer may be graft-copolymerized with the adhering polymer by ionizing radiation, for example. In this case, the adhering polymer may be subjected to ionizing radiation while being dipped in the monomer or monomeric mixture. Or the polymer may be subjected to ionizing radiation after having been dipped in the monomeric compound. An optimal method may be chosen among these methods according for example, to the purpose of using the electrode structure, the type of the adhering polymer, and the shape and material of the electrode. For example, there can be used a method which comprises melt-adhering a sheet of vinylidene fluoride resin to an electrode by heating, dipping the assembly in acrylic acid or a mixture of acrylic acid with styrene or divinyl benzene, then graft-copolymerizing the monomer to the vinylidene fluoride polymer sheet by ionizing radiation, and then fluorinating the graft-copolymer, or a method which comprises heating polyethylene and melt-adhering it to an electrode, dipping the assembly in a heated solution composed of methacrylic acid, divinylbenzene and benzoyl peroxide to impregnate it thoroughly in the polyethylene, heat-polymerizing the monomers with the polyethylene at high pressures in an autoclave, and then fluorinating the resulting graft copolymer. Alternatively, styrenesulfonic acid, or its ester or salt, a styrenesulfonyl chloride or acrylic acid, etc. is graft-copolymerized to a fine powder of polyethylene, etc., and the graft-copolymer is applied to a wire gauze electrode, and adhered to it by heating. In this case, an ion-exchange group may be introduced, if desired, by such means as hydrolysis. In order to impart oxidation resistance, the resulting product may further be fluorinated.

(d) There can also be used a method in which a mold is used. The method comprises adding a crosslinking agent such as divinylbenzene to acrylic acid, methacrylic acid, a styrenesulfonic acid ester, or a vinylsulfonic acid ester, etc., further adding a radical polymerization initiator, if desired uniformly mixing them with other additives such as a solvent as a diluent, a linear polymer, or a finely divided crosslinked polymer, and pouring the resulting monomeric mixture solution into a mold in which an electrode has been inserted as a core, and heat polymerizing the monomers. Where it is desired to impart oxidation resistance, the product may be fluorinated.

Some examples of producing the electrode structure of this invention have been described hereinabove, but is should be understood that the present invention is in no way limited by the above exemplification. Basically, any structures resulting from the lamination of a cation exchange membrane on an electrode by some method are within the scope of the present invention. For example, it is possible to melt-adhere a membrane containing $-SO_2F$ or $-SO_2Cl$, such as NAFION (a trademark for a product made by E. I. du Pont de Nemours & Co.) to an electrode, and then hydrolyze it to render the group cation-exchangeable, for example, $-SO_3H$. Where a monomer is polymerized or copolymerized on an electrode, it is sometimes desirable to cover one or both sides of the electrode with a sheet of flexible polymers, for example, Cellopane, Vinylon, or a fluorine-containing polymer, etc. so as to prevent the monomer from volatilization or being present non-uniformly, and also prevent the occurrence of pinholes, and holes, etc. Furthermore, the polymerization can be performed while rotating the electrode in an autoclave to prevent the deviation of the resin components.

Another essential constituent element of the invention is that the polymer containing an ion exchange group is laminated in the form of a film to one surface of the electrode. In other words, one surface of the electrode is covered with the polymer film having a cation exchange group, and the other surface is exposed. This serves well to remove the gases generated by electrolysis. In order to perform good electrolysis, that surface of the electrode which is coated with the polymeric film containing a cation exchange group should not contain any fine cracks nor pinholes. Preferably, the polymeric film adhered should have a water-permeability about the same as that of an ordinary ion-exchange resin membrane, that is, have a water-permeability of not more than $10^{-5}$cc/cm$^2$.atm.sec. In order to expose one surface of the electrode, the polymer containing a cation exchange group is laminated in the form of a film to only one surface of the electrode. For example, it is effective to cover one surface of the electrode with a material not permeable to the monomers and readily strippable after film formation, such as a sheet of polytetrafluoroethylene (Teflon), cellulose (Cellophane) or polyvinylidene chloride (Saran). However, some of the methods of lamination described above cannot ensure the application of the polymeric film only to one surface of the electrode. In such a case, the film on the other surface is mechanically removed, or where a solvent capable of dissolving the polymeric film is available, the film on the other surface of the electrode may be removed by dissolving with the solvent.

In the anode-structure of this invention resulting from the lamination of a polymer onto an anode, the ion-exchange membrane never separates from the anode owing to the evolution of gases at the anode or the swelling of the ion exchange membrane after a long-term operation. Since the ion-exchange membrane swells or stretches during operation for long periods of time, the advantages of the present invention cannot be achieved by merely setting the membrane on the anode. It might be possible to set the ion-exchange membrane in the pre-stretched state on the surface of the anode. Such a method would however be inapplicable to anodes having a curved surface structure such as a loop anode or finger-type anode and unable to prevent the swelling of the ion-exchange membrane, and therefore is not within the scope of the invention.

When the electrode structure of this invention is used for electrolysis of alkali metal salts, a thin anion exchangeable layer or a thin neutral layer may be present at least on one surface or interior of the cation exchange membrane in order to increase the current efficiency of the alkali metal hydroxide formed. It is especially preferred in this case that the thin layer be crosslinked and compact. The presence of the anion exchangeable or neutral thin layer may be obtained by physical or chemical adhesion or adsorption, or by an ionic bond, covalent bond or coordination bond. Or the thin layer and the cation exchange resin adhere to each other at their interface by the intertwining of the polymer chains. Moreover, the thin layer may be present in the form of a layer on the cation exchange resin part; or it may be present also in the surface layer of the cation exchange resin toward its interior as a result of some suitable chemical reaction.

Any known functional groups which yield a negative charge in aqueous solutions may be used in the present invention as the ion exchange groups to be present combined with the cation exchangeable resin part. They include, for example, a sulfonic acid group, a carboxylic acid group, a phosphoric acid group, a phosphorous acid group, a sulfate ester group, a phosphate ester group, a phosphite ester group, a phenolic hydroxyl group, a thiol group, a boric acid group, a silicic acid group, and a stannic acid group. These ion exchange groups may be present to such an extent that the polymer to be laminated in the form of a film functions as an ion exchange membrane.

In the thin anion exchangeable layer to be present in a layer in the surface layer of the polymeric film, there is contained an onium base having a functional group capable of yielding a positive charge in aqueous solutions, such as quaternary ammonium, tertiary sulfonium, quaternary phosphonium, arsonium, stibonium, or cobalticinium and primary, secondary, and tertiary amines. Neutral thin layers effective in this invention are those which do not contain a functional group dissociable in aqueous solutions, or those which contain almost equivalent weights of both an anion exchange group and a cation exchange group of the types described hereinabove. When the thin layer is present in the surface layer, a cation exchange resin component may further be present on the thin anion exchangeable layer and the neutral thin layer thus forming a sandwich construction of anion exchangeable and cation exchangeable thin layers. In order to increase the strength of the polymeric film layer to be formed on the electrode, a woven fabric, a non-woven fabrics, staple fibers, or continuous filaments may be present. Desirably, the fibrous materials are composed of a fluorine-containing polymer such as polytetrafluoroethylene, poly(monochlorotrifluoroethylene), polyfluoroethylene, polyvinylidene fluoride, and a copolymer of hexafluoropropylene and tetrafluoroethylene. Sometimes, fibrous materials composed of, for example, polypropylene, polyethylene, polyvinyl chloride, polyvinyl alcohol, polyvinylidene chloride, glass fibers, polyesters, and polyacrylonitriles, can be used with good results.

The anode-structure for electrolysis according to this invention which is obtained by laminating the polymeric film containing a cation exchange group on one surface of an anode can be used in any desired modes for electrolysis together with a cathode as a pair in a system in which an anolyte solution does not mix with a catholyte solution and selective permeation of cations is required. For example, it is effective for organic electrolytic reactions, or an electrolytic dimerization reaction of acrylonitrle. It can also be utilized for electrolysis of solutions of a wide range of inorganic electrolytes in addition to the electrolysis of alkali metal salts.

The anode-structure of the invention, nevertheless, is particularly effective for the electrolysis of alkali metal salts, for example, halides, sulfates, nitrates, and phosphates of lithium, sodium, potassium, rubidium, and cesium. It can be used also for electrolysis of acids such as hydrochloric acid, sulfuric acid, nitric acid or phosphoric acid.

Generally, it is preferred to use fluorine-containing polymers having oxidation resistance as the polymer to be laminated on the anode. When the electrode structure of this invention contains a cation exchange resin portion which is made of a material having resistance to oxidizing agents, such as fluorine-containing materials and inorganic materials, they may be used as such. When the cation exchange resin portion is made of a hydrocarbon-type material having no oxidation resistance, and an oxidizing substance is generated from the anode at the time of electrolysis, the cation exchange membrane portion may be subjected to a treatment of imparting oxidation resistance thereto, for example, fluorination or chlorination in order to prevent the oxidative degradation of the resin portion.

As described hereinabove, the anode-structure of the present invention can be obtained by a simple procedure, and has various superior results. For example, it permits the stable supporting of the diaphragm, operations at lower cell voltage, and the prolongation of the lives of the diaphragm and the anode. Furthermore, the output per unit electrolytic cell can be increased, and the purity of the chlorine gas generated at the anode is increased. Moreover, it serves to increase the current efficiency and reduce the power consumption.

The following Examples illustrate the present invention in greater detail. It should be understood that these Examples do not limit the invention in any way.

EXAMPLE 1

A plain weave fabric of polytetrafluoroethylene was interposed between two 5-mil thick films of a copolymer of tetrafluoroethylene and perfluoro(3,6-dioxa-4-methyl-7-octenesulfonyl fluoride) which has an ion exchange capacity corresponding to 0.91 meq/g of dry menbrane ($H^+$ type, 1100 equivalent weight) in the hydrolyzed state, and by melt-adhesion under heat, made into a single film structure. Furthermore, a 1.5 mil thick film of the same copolymer having an ion exchange capacity corresponding to 0.67 meq/g of dry weight ($H^+$ type, 1500 equivalent weight) in the hydrolyzed state was superimposed on the resulting structure and melt-adhered to form a single polymeric membranous product.

One surface of a titanium lath material was mechanically roughened, and the other surface was coated with 2 $RuO_2.TiO_2$ in such a way that the coating did not adhere to the roughened surface. A dispersion of polytetrafluoroethylene was coated on the roughened surface, dried, and heated to 370° C. to coat the uncoated surface with the polytetrafluoroethylene.

That side of the resulting polymeric membranous product which had a higher exchange capacity was pressed into the anode by heating, whereby the titanium lath electrode entered the polymeric membranous product. The assembly was immersed in an 8% methanol solution of potassium hydroxide at room temperature for 48 hours to convert the sulfonyl fluoride group to a potassium sulfonate group to obtain a unitary structure of the cation exchange membrane and the insoluble anode.

A two-compartment electrolytic cell was built by combining this structure with a nickel-plated iron mesh cathode. In this case, that side of the anode-structure on which the anode was not exposed was placed facing the cathode and the distance between the cathode and the anode was adjusted to 3 mm. Using this electrolytic cell, a saturated aqueous solution of sodium chloride was electrolyzed. Specifically, the saturated solution of sodium chloride was fed into the anode compartment at such a speed that the rate of decomposition would become 45%. Pure water was fed into the cathode compartment so that a 6.0N aqueous solution of sodium hydroxide could be steadily obtained from the cathode compartment. The electrolyzing temperature was 85° C., and the current density was 40 $A/dm^2$.

For comparison, the following experiment was conducted to illustrate the case where the anode was not laminated to the ion exchange membrane.

A woven fabric of polytetrafluoroethylene was interposed between two polymeric films, 5 mil thick and same as those used hereinabove, having an ion exchange capacity of 0.91 meq/g of dry membrane ($H^+$ type), and melt-adhered under heat. A 1.5-mil thick polymeric film having an ion exchange capacity of 0.67 meq/g of dry membrane ($H^+$ type) was melt-adhered under heat to the resulting assembly to form a single polymeric membranous product. The resulting product was immersed in an 8% methanol solution of potassium hydroxide to hydrolyze it and obtain a sulfonic acid-type cation exchange membrane. Separately, an insoluble anode was produced by coating the entire surfaces of the same titanium lath material with $2RuO_2.TiO_2$. A filter-press type two-compartment electrolytic cell was built by interposing the ion exchange membrane between the insoluble anode and the same cathode as used hereinabove. The distance between the anode and the cathode was maintained at 3 mm, and the membrane was brought into contact with the anode by applying a water pressure of 100 mm. The electrolyzing temperature, the current density, the decomposition ratio of saturated solution of sodium chloride, and the sodium hydroxide concentration in the cathode compartment were maintained the same as in the case of using the above laminated anode-structure. This electrolysis was continued for 3 months by maintaining the conditions as constant as possible. When the electrolysis was performed for another one year by maintaining the conditions as constant as possible, the coating of the anode at the part of contact with the cation exchange membrane somewhat stripped off owing to friction with the membrane. The effective electricity-flowing area was 1 $dm^2$ in either case.

The cell voltage, the current efficiency, and sodium chloride concentration were measured, and the results are shown in Table 1.

Table 1

| | | Current efficiency (%) | Amount (ppm) of NaCl in NaOH (calculated on 48% NaOH) | Cell voltage (V) |
|---|---|---|---|---|
| When the anode-structure of the invention was used | at the outset | 84 | 40 | 3.85 |
| | 3 months later | 83 | 45 | 3.90 |
| When the filter-press type cell was used | at the outset | 82 | 75 | 4.00 |
| | 3 months later | 80 | 80 | 4.25 |

EXAMPLE 2

A 0.3-mm thick polymeric film of the following structural formula

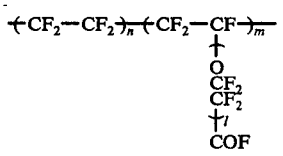

(a mixture of $l = 1$, 2 and 3) was laminated to an anode to build a laminated anode-structure in accordance with the present invention. The membrane was hydrolyzed to convert —COF to —COOH. The hydrolyzed product had an ion exchange capacity of 0.833 meq/g of dry membrane ($H^+$ type) (1200 equivalent weight). The anode used was built by coating one surface of a titanium lath material with platinum-iridium, coating the other side with a dispersion of a copolymer of tetrafluoroethylene and hexafluoropropylene (Neoflon Dispersion ND-1, a trademark for a product of Daikin Kogyo K.K.), air-drying the coating and then heat-treating it at 300° C. The carboxylic acid halide-type polymeric film was melt-adhered under heat to the copolymer-coated surface of the anode to produce the anode-structure of this invention. In this case, the polymeric film did not melt-adhere to the platinum-iridium-coated surface of the anode, but melt-adhered to that surface which was coated with a copolymer of tetrafluoroethylene and hexafluoropropylene. Furthermore, a part of the electrode surface coated with the copolymer of tetrafluoroethylene and hexafluoropropylene remained uncovered with the carboxylic acid halide-type film after its melt-adhesion.

Using the resulting unitary anode-structure and a mild steel spaghetti cathode in pair, a saturated aqueous solution of sodium chloride was electrolyzed. The distance between the anode and the cathode was adjusted to 3 mm, and the current density was 30 $A/dm^2$. The ratio of decomposition of the saturated solution of sodium chloride at the anode was 70%. Pure water was fed into the cathode compartment so as to obtain an 8.0N aqueous solution of sodium hydroxide steadily. During electrolysis, the temperature of the inside of the cell was maintained at 90° C.

For comparison, a saturated solution of sodium chloride was electrolyzed in an ordinary filter press type electrolytic cell using a 0.3-mm thick cation exchange membrane of the same carboxylic acid-type tetrafluoroethylene/perfluoro polymer as set forth above. In this case, the anode used was obtained by coating the entire surface of a titanium lath material with platinum-iridium, and the cathode used was the same as the mild steel spaghetti type electrode as used hereinabove. The cation exchange membrane was brought into contact with the anode by applying a water pressure of 100 mm to the cathode compartment. The electrolyzing temperature, the utilization ratio of sodium chloride solution, the current density and the other conditions were maintained the same as those used in the case of using the laminated anode-structure.

The effective electricity-flowing area in the electrolysis was 3 $dm^2$ (50 × 600 mm) in either case, and the cell used was of an elongated shape.

The electrolysis was performed for about 3 months under the same conditions.

When the electrolysis was continued for another one year under the same conditions, the coated surface of the anode became especially thin at the upper part of the anode in the elongated cell owing to friction with the cation exchange membrane (in the case of using the filter press type cell). In the filter press electrolytic cell, the amount of sodium chloride in sodium hydroxide increased to 78 ppm after a lapse of one year, but in the case of using the laminated anode-structure of this invention, the sodium chloride concentration reached only 30 ppm. The cell voltage, the current efficiency and the sodium chloride concentration were measured, and the results are shown in Table 2.

Table 2

| | | Current efficiency (%) | Amount (ppm) of NaCl in NaOH (calculated on 48% NaOH) | Cell voltage (V) |
|---|---|---|---|---|
| When the anode-structure of the invention was used | at the outset | 92 | 25 | 3.52 |
| | 3 months later | 92 | 25 | 3.55 |
| When the filter press type electrolytic cell was used | at the outset | 91 | 40 | 3.70 |
| | 3 months later | 90 | 45 | 3.88 |

EXAMPLE 3

Two 2-mil thick films of a copolymer of tetrafluoroethylene and perfluoro(3,6-dioxa-4-methyl-7-octenesulfonyl fluoride) having an ion exchange capacity corresponding to 0.91 meq/g of dry membrane ($H^+$ type, 1100 equivalent weight) in the hydrolyzed state were melt-adhered under heat to form a single polymeric film structure. A 2-mil thick film of the same copolymer having an ion exchange capacity corresponding to 0.67 meq/g of dry membrane ($H^+$ type, 1500 equivalent weight) in the hydrolyzed state was superimposed on it and melt adhered thereto to form a single polymeric membranous product.

On the other hand, one surface of a finger-type titanium lath material was coated with ruthenium dioxide and titanium dioxide, and the other surface was coated with an emulsion of polyvinylidene fluoride, followed by air drying and heating at 250° C.

That surface of the polymeric membranous product obtained hereinabove which had a higher ion exchange capacity was melt-adhered under heat to that surface of the titanium lath material which was coated with the polyvinylidene fluoride to make a unitary structure. The structure obtained was immersed in diethylene triamine, at 120° C. for 24 hours, and then heated at 180° C. for 30 minutes to bind the diethylenetriamine to the polymeric membrane by an acid-amide linkage and to form a crosslinked structure in a part of the resulting structure. The resulting structure was immersed in an 8% methanol solution of potassium hydroxide at room temperature for 24 hours to convert the remaining sulfonyl fluoride group to a potassium sulfonate group. Using the resulting laminated anode-structure and a mesh cathode made of nickel-plated mild steel in pair with the distance between them being adjusted to 3 mm, a saturated aqueous solution of sodium chloride was fed into the anode compartment at an electrolyzing ratio of 35%. Pure water was introduced into the cathode compartment so as to obtain a 6.0N aqueous solution of sodium hydroxide steadily from the cathode compartment.

Separately, an anode made by coating the entire surface of a titanium lath material of the same size with ruthenium dioxide and titanium dioxide, and a cathode made by plating a mild steel mesh with nickel were used in pair. A perfluorosulfonic acid-type cation exchange resin was interposed between the electrodes such that it was brought into contact with the anode as much as possible along its bended surface. Electrolysis was carried out under the same conditions as in the case of using the laminated anode-structure of the present invention. In this case, the cation exchange membrane used was produced by melt-adhering under heat two 2-mil thick films of a copolymer of tetrafluoroethylene and perfluoro(3,6-dioxa-4-methyl-7-octenesulfonyl fluoride) having an ion exchange capacity corresponding to 0.91 meq/g of dry membrane ($H^+$ type, 1100 equivalent weight) to form a single polymeric membranous product, melt-adhering a 2-mil thick polymeric film of the same copolymer having an ion exchange capacity in the hydrolyzed state of 0.67 meq/g of dry membrane ($H^+$ type, 1500 equivalent weight) to the above membrane, and treating the resulting assembly with diethylenetriamine and then with an 8% methanol solution of potassium hydroxide.

In the electrolysis, the current density was about 30 A/dm$^2$, and the actual effective area of the membrane was 50 dm$^2$ in either case. The cathode and the anode were set perpendicular to the floor surface, and when seen vertically, formed a wavy structure. The temperature of the electrolytic cell was about 90° C.

When the cation exchange membrane and the anode were not laminated, the membrane made contact not only with the anode but also with the cathode. It also swelled during electrolysis, and gases generated stayed within the cell.

The cell voltage, the current efficiency, and the sodium chloride concentration were measured, and the results are shown in Table 3.

Table 3

| | | Current efficiency (%) | Amount (ppm) of NaCl in NaOH (calculated on 48% NaOH) | Cell voltage (V) |
|---|---|---|---|---|
| When the laminated anode-structure of the invention was used | at the outset | 95 | 43 | 3.65 |
| | 3 months later | 95 | 43 | 3.70 |
| When the anode and the membrane were used separately | at the outset | 95 | 85 | 4.15 |
| | 3 months later | 94 | 85 | 4.85 |

EXAMPLE 4

The same finger-type laminated anode-structure as made in Examle 3 and the same nickel-plated mild steel cathode as used in Example 3 were used in pair. A saturated aqueous solution of sodium chloride was electrolyzed at a current density of 30 A/dm$^2$ so that the concentration of sodium chloride in the anolyte became 1.0N on an average. Pure water was not fed into the cathode compartment. As a result, 33% of sodium hydroxide could be obtained from the cathode compartment at a current efficiency of 92%. The cell voltage was 3.85 V.

EXAMPLE 5

A finger-type insoluble anode was prepared by coating only one surface of a titanium lath material (expanded metal) with iridium-platinum. The coated surface of the anode was covered with a Teflon sheet, and then a 0.3 mm-thick sheet of a thermoplastic perfluoropolymer of the following structural formula

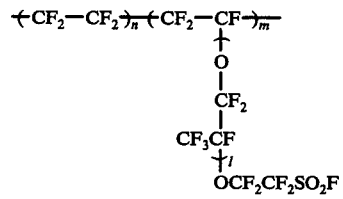

was superimposed on the other surface and melt-adhered thereto by heating. Then, the Teflon sheet was stripped off, and the anode assembly was dipped in a 1N aqueous solution of sodium hydroxide to convert the polymer into the sodium type. When the polymer sheet was melt adhered to the anode wire gauze, a part of it entered the network interstices of the titanium lath material. The resin which was applied also to the coated surface of the anode was shaved off to expose the iridium-platinum-coated surface. Freedom from water leakage was confirmed by applying a water pressure of 5 m -water from outside the wire gauze. An aqueous solution of sodium chloride was electrolyzed at 20 A/dm$^2$ using the resulting structure as an anode and a spaghetti electrode made of nickel as a cathode and pure water was fed to the cathode compartment. A 6.0N aqueous solution of sodium hydroxide was obtained steadily from the cathode compartment. At this time, the voltage between the electrodes was 3.85 V at 60° C., and the current efficiency of sodium hydroxide formation was 65%. When the 6.0N aqueous solution of sodium hydroxide was concentrated to a concentration of 50%, it contained 130 ppm of sodium chloride.

EXAMPLE 6

The same anode-structure as used in Example 5 having the sulfonyl fluoride-type perfluoro polymer melt-adhered thereto was dipped in each of the reaction baths (shown in Table 4) for each of the periods indicated in Table 4, and then in a 1N aqueous solution of sodium hydroxide. Using the resulting anode-structure, the same electrolysis of sodium chloride as in Example 5 was performed at a temperature of 60° C. The results are shown in Table 4.

Table 4

| Reaction bath | Dipping periods (hours) | Concentration of NaOH obtained (N) | Current efficiency (%) | NaCl in NaOH (ppm, calculated on 50% NaOH) | Voltage between the electrodes (V) |
|---|---|---|---|---|---|
| Diisopropylamine | 2.0 | 6.1 | 93 | 120 | 3.90 |
| Diethyl amine | 1.0 | 6.0 | 94 | 120 | 3.98 |
| Tetraethylene pentamine | 24.0 | 6.1 | 95 | 100 | 3.92 |
| Piperazine | 1.5 | 5.8 | 93 | 150 | 3.90 |
| Propyl amine | 3.0 | 5.7 | 88 | 180 | 3.88 |

EXAMPLE 7

A copolymer of tetrafluoroethylene and perfluoro(3,6-dioxa-4-methyl-7-octenesulfonyl fluoride) [$CF_2=CFOCF_2CF(CF_3)OCF_2CF_2SO_2F$] was heat-melted and fabricated into two types of sheets one having an ion exchange capacity of 0.9 meq/g of dry membrane (0.1 mm) and the other having an ion exchange capacity of 0.7 meq/g of dry membrane (0.1 mm). A woven fabric of polytetrafluoroethylene (Teflon) was interposed between the two sheets and melt-adhered into a single sheet. A titanium lath material was coated on one surface with rhodium and the above sheet was melt-adhered to the other uncoated surface of the titanium latch material. The assembly was dipped in a 1N aqueous solution of sodium hydroxide at 30° C. to convert the sulfonyl fluoride group to sodium sulfonate. The resulting anode-structure was placed in pair with a spaghetti cathode made of stainless steel so that the surface to which the ion exchange membrane adhered faced toward the cathode, and an electrolytic cell was built. A saturated aqueous solution of sodium chloride was flowed into the anode compartment, and the cathode compartment was filled with a 20% aqueous solution of sodium hydroxide. Electrolysis was performed at a current density of 30 A/dm$^2$. Pure water was fed so that a 20% aqueous solution of sodium hydroxide was obtained steadily from the cathode compartment. At this time, a hydrogen gas was obtained from the cathode under a pressure of 0.2 m-water. Under these electrolysis conditions, the voltage between the electrodes was 3.9 V, and the current efficiency of sodium hydroxide formation was 76%. The concentration of sodium chloride therein calculated on a 48% aqueous solution of sodium hydroxide was 63 ppm.

EXAMPLE 8

The same anode-structure as built in Example 7 and a stainless steel spaghetti cathode were connected to each other so that their backs faced to build a bipolar electrode in which the cation exchange membrane was adhered to the outside of the anode. Five pairs of such anode and cathode were built as a unit, and a saturated aqueous solution of sodium chloride was flowed as an anolyte solution. Pure water was fed into the cathode, and a 20% aqueous solution of sodium hydroxide was obtained from the catholyte solution. The current efficiency was 75%, and the concentration of sodium chloride therein calculated on a 48% aqueous solution of sodium hydroxide was 65 ppm. In this case, the surface area of the electrodes was 1.5 m$^2$.

EXAMPLE 9

Each of the monomeric mixtures shown in Table 5 was coated on the outside of the anode-structure obtained in Example 5, and the coated structure was heated in an autoclave to impregnate the monomeric mixture partly into the inside of the membrane and polymerize it. The polymeric film-adhered surface of the anode-structure was set facing a finger type electrode consisting of a net of nickel as a cathode. A saturated aqueous solution of sodium chloride was flowed into the anode compartment, and pure water was fed into the cathode compartment whereby a 6.0N aqueous solution of sodium hydroxide was obtained steadily from the cathode compartment. The electrolysis was performed at 20 A/dm$^2$. The results are also shown in Table 5.

Table 5

| Monomer | Composition (parts by weight) | Current efficiency (%) | Concentration of NaOH (N) | Concentration of NaCl calculated on 48% NaOH | Voltage between electrodes (V) |
|---|---|---|---|---|---|
| Styrene | 20 | | | | |
| Divinyl benzene (55% pure) | 10 | 89 | 6.0 | 30 | 3.88 |
| Styrene | 20 | | | | |
| Divinyl benzene (55% pure) | 10 | 93 | 6.0 | 35 | 3.85 |
| 2-Methyl- | | | | | |

Table 5-continued

| Monomer | Composition (parts by weight) | Current efficiency (%) | Concentration of NaOH (N) | Concentration of NaCl calculated on 48% NaOH | Voltage between electrodes (V) |
|---|---|---|---|---|---|
| 5-vinyl pyridine | 20 | | | | |
| Styrene | 20 | | | | |
| Divinyl benzene (55% pure) | 10 | 92 | 6.0 | 28 | 3.86 |
| Methacrylic acid | 20 | | | | |
| None | — | 65 | 6.0 | 130 | 3.85 |

EXAMPLE 10

One surface of an insoluble anode material of the finger type made of a titanium lath material was coated with $2RUO_2:TiO_2$, and a sheet of XR resin (—$SO_2F$; a trademark for a product of E. I. du Pont de Nemours & Co.) was melt-adhered to the other surface. Using the resulting anode-structure and a finger-type iron mesh cathode in pair, a saturated aqueous solution of sodium chloride was fed to the electrolytic cell and electrolyzed at a current density of 20 A/dm$^2$. It was discharged as a 1.5N aqueous solution of sodium chloride, and a 37% aqueous solution of sodium hydroxide was obtained. The current efficiency was 78%, and the cell voltage was 4.10 V. On the other hand, when a saturated aqueous solution of sodium chloride was electrolyzed and a 4.7N aqueous solution of sodium chloride was discharged, the current efficiency of obtaining a 20% aqueous solution of sodium hydroxide was 65%. The cell voltage was 3.85 V.

EXAMPLE 11

The anode-structure obtained in Example 5 was dipped in diethylene triamine, and heated to 80° C. It was allowed to stand for 48 hours at 80° C. to bond the diethylene triamine to the polymer by an acid amide linkage. Then, the assembly was immersed in a 20% aqueous solution of monochloroacetic acid, and heated to 90° C. to bond a carboxylic acid group as ion exchange group. The structure was then immersed in a 1N aqueous solution of sodium hydroxide at 25° C. for 24 hours to convert the remaining sulfonyl fluoride group to a sodium sulfonate group, and thereby to form a membrane having both a carboxylic acid group and a sulfonic acid group. Using the resulting anode-structure and a finger-type iron cathode in pair, a saturated aqueous solution of sodium chloride was electrolyzed, and a 20% aqueous solution of sodium hydroxide was obtained. The current efficiency was 82%.

EXAMPLE 12

A 0.3 mm-thick sheet of the perfluorosulfonic acid type made of XR resin (a product of E. I. du Pont de Nemours & Co.) was heated and melt-adhered to a net of platinum to form an anode-structure consisting of a unitary structure of the anode and the cation exchange membrane. The anode-structure was immersed in a 1.0N aqueous solution of sodium hydroxide at 25° C. for 24 hours. Using the resulting anode-structure and an iron net in pair, a saturated aqueous solution of potassium chloride was electrolyzed at 20 A/dm$^2$, and a 5.0N aqueous solution of potassium hydroxide was obtained from the cathode compartment. The current efficiency was 73%, and the concentration of potassium chloride therein calculated on 50% KOH was 120 ppm.

What we claim is:

1. An anode-structure for liquid-phase electrolysis of an aqueous solution of an alkali metal salt comprising an anode having a curved surface and a polymer containing cation exchange groups, said polymer being laminated in the form of a film on the curved surface of said anode.

2. The anode-structure of claim 1 wherein said polymer is a fluorine-containing ion exchange resin.

3. The anode-structure of claim 1 wherein the anode is a finger-type electrode.

4. The anode-structure of claim 1 wherein the curved surface of the anode is electrochemically inactive and the polymer is laminated in the form of a film on the inactive surface of said anode.

5. The anode-structure of claim 1 wherein the polymer is laminated on the anode by melt-adhesion of the polymer.

6. The anode-structure of claim 1 wherein the polymer is laminated by directly forming a film of the polymer on one surface of the anode.

7. In an electrolytic cell equipped with an anode, a cathode and a cation exchange membrane completely separating the anode and cathode, the improvement comprising as said anode, the anode-structure of claim 1.

8. In a process for electrolysis of an aqueous solution of an alkali metal salt, the improvement using the anode-structure of claim 1 as the anode.

* * * * *